US010041629B2

(12) United States Patent
Krencker

(10) Patent No.: US 10,041,629 B2
(45) Date of Patent: Aug. 7, 2018

(54) COLD GAS SUPPLY DEVICE AND NMR INSTALLATION COMPRISING SUCH A DEVICE

(71) Applicant: BRUKER BIOSPIN, Wissembourg (FR)

(72) Inventor: Patrick Krencker, Brumath (FR)

(73) Assignee: BRUKER BIOSPIN, Wissembourg (FR)

( * ) Notice: Subject to any disclaimer, the term of this patent is extended or adjusted under 35 U.S.C. 154(b) by 107 days.

(21) Appl. No.: 13/653,591

(22) Filed: Oct. 17, 2012

(65) Prior Publication Data

US 2013/0091870 A1 Apr. 18, 2013

(30) Foreign Application Priority Data

Oct. 17, 2011 (FR) ..... 11 59356

(51) Int. Cl.
*F17C 9/02* (2006.01)
*F25D 3/10* (2006.01)
(Continued)

(52) U.S. Cl.
CPC ..... *F17C 9/02* (2013.01); *F25D 3/10* (2013.01); *F17C 9/04* (2013.01); *F17C 13/007* (2013.01);
(Continued)

(58) Field of Classification Search
CPC .. F17C 9/02; F17C 9/04; F17C 13/007; F17C 2227/0339; F17C 2227/0341;
(Continued)

(56) References Cited

U.S. PATENT DOCUMENTS 3,696,636 A * 10/1972 Mille ..... 62/399
5,193,349 A * 3/1993 Laverman et al. ..... 62/64
(Continued)

FOREIGN PATENT DOCUMENTS

FR 2926629 7/2009
JP 60000817 * 1/1985
(Continued)

OTHER PUBLICATIONS

Odera, JPS62224987TRANS (English translation), Oct. 1987.*
(Continued)

*Primary Examiner* — Len Tran
*Assistant Examiner* — Eric Ruppert
(74) *Attorney, Agent, or Firm* — Young & Thompson

(57) ABSTRACT

A device for supplying cold gases to an NMR installation or analytical apparatus equipped with a measuring probe, with cold gases ensuring the cooling of the sample contained in the probe, but also its lift and rotation, the device including an insulated tank containing liquid gas at boiling point and in which are arranged exchangers through which gas streams to be cooled pass, these exchangers being connected to transfer lines channeling the cooled gases to the probe. The device also includes at least one additional exchanger that ensures a pre-cooling of the gas stream before it is channeled to the corresponding exchanger, with the or each additional exchanger coming in the form of a double-flow exchanger that is supplied either by the gaseous vapor produced by the boiling of the liquid gas in the tank or by the cold gas that is evacuated or that escapes at the probe.

10 Claims, 5 Drawing Sheets

(51) Int. Cl.
*F17C 13/00* (2006.01)
*F17C 9/04* (2006.01)

(52) U.S. Cl.
CPC ..... *F17C 2227/0339* (2013.01); *F17C 2227/0372* (2013.01); *F17C 2227/0374* (2013.01)

(58) Field of Classification Search
CPC ..... F17C 2227/0369; F17C 2227/0372; F17C 2227/0374
USPC ..... 62/48.1, 48.3, 51.1
See application file for complete search history.

(56) References Cited

U.S. PATENT DOCUMENTS 5,247,256 A * 9/1993 Marek ..... 324/321
5,339,654 A * 8/1994 Cook et al. ..... 62/476
5,499,462 A * 3/1996 Forsdahl et al. ..... 37/227
6,204,665 B1 * 3/2001 Triebe et al. ..... 324/318
6,438,969 B1 * 8/2002 Laskaris et al. ..... 62/51.1
6,442,949 B1 * 9/2002 Laskaris et al. ..... 62/51.1
7,498,812 B2 * 3/2009 Doty ..... 324/318
2009/0183860 A1 * 7/2009 Krencker et al. ..... 165/164

FOREIGN PATENT DOCUMENTS

JP S62224987 * 10/1987
WO WO2005101949 * 11/2005

OTHER PUBLICATIONS

Amano, JP60000817MT (English Translation), Jan. 1985.*
P.J. Allen, et al.; "Apparatus for Low-Temperature Magic-Angle Spinning NMR"; May 1, 1991, vol. 92 No. 3; pp. 1-3.
French Search Report dated May 4, 2012, corresponding to the French Patent Application No. 11 59356.

* cited by examiner

COLD GAS SUPPLY DEVICE AND NMR INSTALLATION COMPRISING SUCH A DEVICE

BACKGROUND OF THE INVENTION

Field of the Invention

This invention relates to the field of equipment and installations for measurement and imagery using nuclear magnetic resonance (NMR), in particular the NMR techniques called LT MAS (Low Temperature Magic Angle Spinning—rotation at a magic angle and at low temperature).

More particularly, the invention has as its object a device for supplying cold gases to an NMR apparatus or installation of the above-mentioned type, as well as a corresponding installation.

Description of the Related Art

Certain measuring probes of the LT MAS NMR type operate with very cold gases at temperatures that are close to liquid nitrogen (77.3 K). These gases ensure the lift and the spinning of the sample that is generally contained in a small tube called a rotor that is inserted in a stator, but also the cooling of this sample.

For this purpose, three separate gaseous streams are used, and said gaseous streams are generally designated by: "VT" (gas for cooling the sample), "Bearing" (bearing), and "Drive" (drive). These gases traditionally have pressures of 1 to 4 bar, and typical flow rates vary from 20 to 60 NI/minute. The pressure and the flow rate depend on the speed of rotation of the sample that is programmed by the user.

Usually, these above-mentioned gases, coming from a pressurized cylinder, of from a supply tank, are cooled by passing into three exchangers (one per gas) contained in three pressurized chambers that are partially filled with liquid nitrogen. The internal pressure of each chamber is regulated and kept constant by an electronic controller. The controller regulates the internal pressure of the chambers by controlling the heating power of heating resistors immersed in the liquid nitrogen of the chambers.

At constant pressure, the boiling liquid nitrogen in the chamber is in equilibrium with its vapor and it means that the temperature of the liquid nitrogen is constant. In this way, the temperature of the liquid nitrogen of each chamber is controlled. For a stable rotation of the MAS rotor, it is essential to provide dry gases that do not contain liquefied gases.

This mechanical unit that consists of these three exchangers constitutes a cold-gas supply device, commonly called an LT MAS cooling device.

An example of such a device is described in the document FR-A-2 926 629.

These known cooling devices operate perfectly, but have the drawback of consuming an excessive quantity of liquid nitrogen.

Thus, the consumption can reach 20 l/hour, or 480 liters per day, at high spinning rates. The total consumption of liquid nitrogen is directly proportional to the internal pressure of chambers containing the exchangers.

However, the pressure of each chamber is depending on the speed of rotation of the rotor. A high spinning rate is obtained with higher gas flows, in particular for the "Drive" and "Bearing" gases and the gas pressure drop in the gas exchangers tubings increases. Consequently the pressure setpoint of the chambers must be increased as well. The heat exchange surfaces of the chambers are sized to be able to evacuate the maximum thermal power.

Quite obviously, a significant consumption of liquid nitrogen involves a significant increase of the operating cost of the installation and requires frequent manipulation of tanks of liquid nitrogen by the user. To ensure a continuous operation of the device 24/24 hours, the user must typically install twice a day a full 2001 LN2 tank. This tank is used to refill and keep the level constant in the tank containing the chambers equipped with the exchangers.

Although the document FR-A-2 926 692 mentions a possibility of pre-cooling, only the exploitation of the boil off gas of the tank is mentioned, and no practical functional detail or design detail is provided. This invention has as its object to overcome the above-mentioned drawbacks by proposing an optimized solution that makes it possible to reduce significantly the consumption of liquid nitrogen in the above-mentioned devices, while taking into account specific features of the different gaseous streams in question.

SUMMARY OF THE INVENTION

For this purpose, the invention has as its object a device for supplying cold gases to an NMR installation or analytical apparatus that is equipped with a measuring probe, with said cold gases ensuring the cooling of the sample that is contained in the probe, but also its lift and rotation, Said supply device essentially comprising an insulated tank containing liquid gas at boiling point and in which are arranged exchangers through which gas streams that are to be cooled pass, with these exchangers being connected to one or more transfer lines channeling the cooled gases to the probe, Said device also comprising at least one additional exchanger that ensures a pre-cooling of the gas stream in question before it is channeled to the corresponding exchanger, with said or each additional exchanger is a double-flow exchanger, Device that is characterized in that upstream relative to the gaseous stream in question, an additional pre-cooling exchanger, supplied either by the gaseous vapor produced by the boiling of the liquid gas in the tank or by the cold gas that escapes at the probe, is combined with each exchanger, In that the additional exchanger that ensures the pre-cooling of the gas that is intended to cool the sample is supplied with gaseous vapor that is produced by the boiling of the liquid gas in the tank, and In that the additional exchangers that ensure the pre-cooling of the cold gases intended to ensure respectively the lift and the rotation of the sample are supplied by the gases that are evacuated or that escape at the probe.

BRIEF DESCRIPTION OF THE DRAWING FIGURES

The invention will be better understood thanks to the description below, which relates to preferred embodiments, provided by way of nonlimiting examples and explained with reference to the accompanying diagrammatic drawings, in which.

Figure 1:
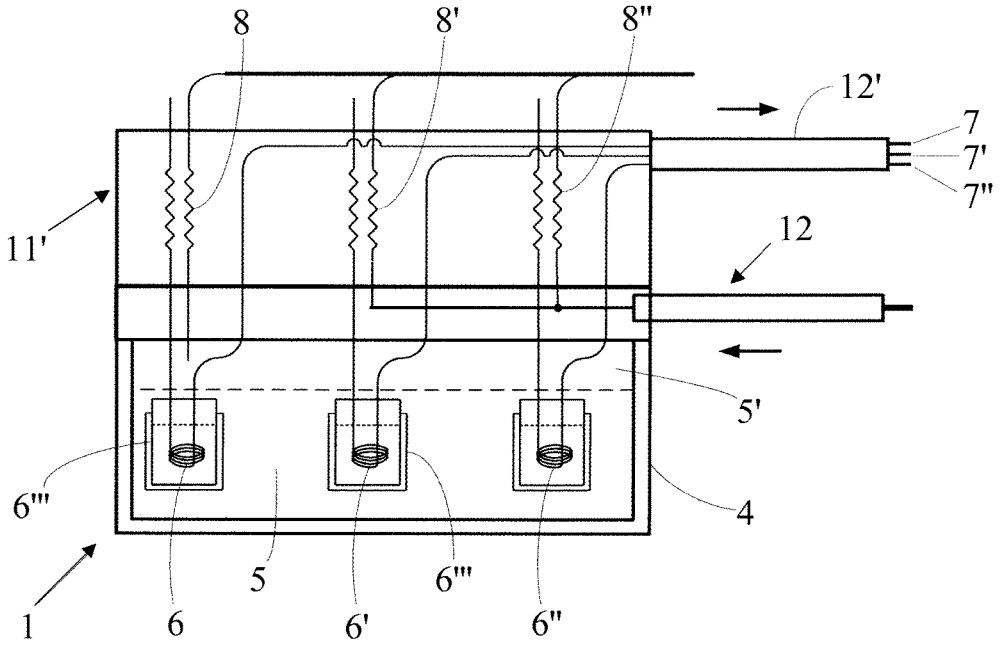
FIG. 1 is a schematic outline of the supply device according to the invention.
Figure 2:
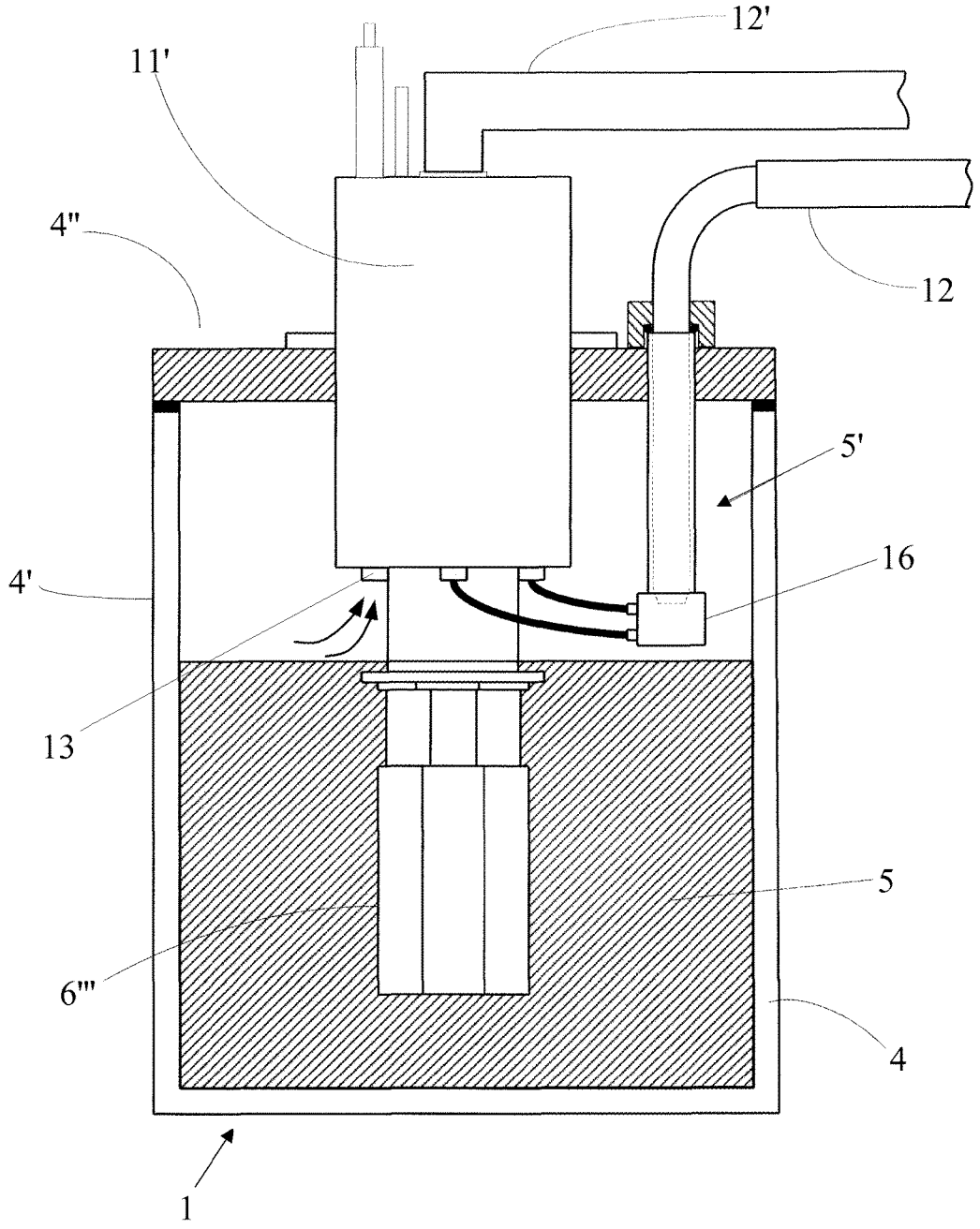
FIG. 2 is a side cutaway view of a supply device according to an advantageous embodiment of the invention.
Figure 4:
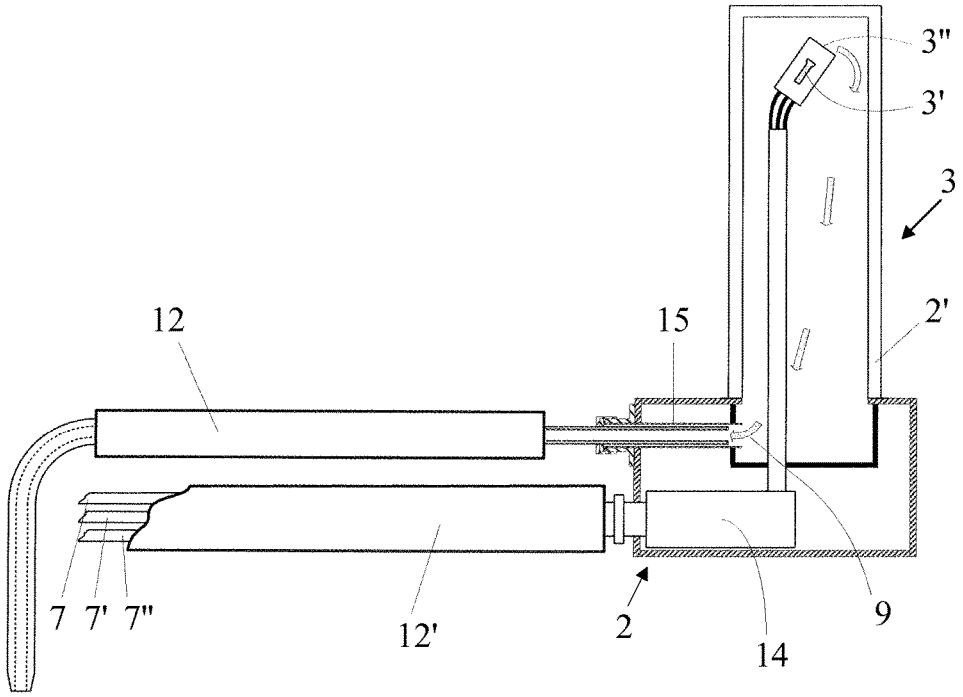
Figure 5:
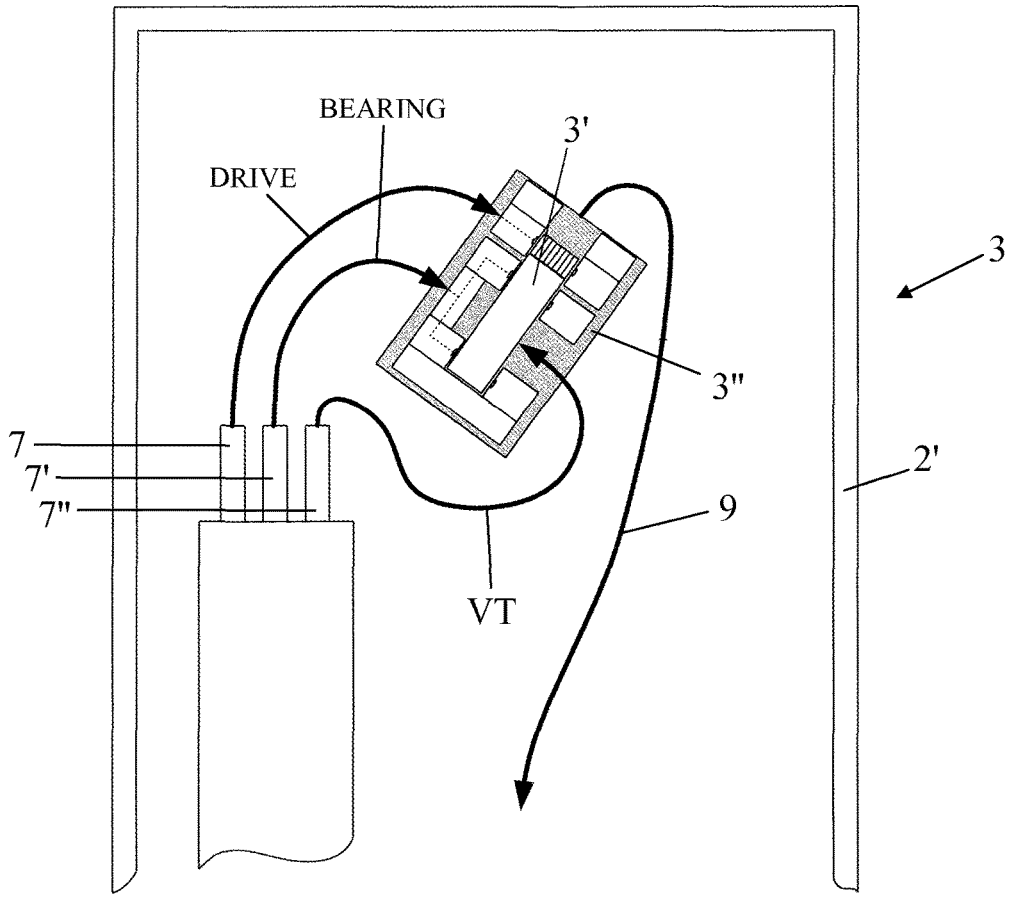

FIG. 4 is a partial diagrammatic representation of an NMR measuring installation (only the structure enveloping the probe is shown and not the NMR apparatus itself), showing the fluid connections connecting it to a supply device as shown in FIGS. 1 and 2, and FIG. 5 is a more detailed partial representation on a different scale from the portion of the probe that surrounds the sample, being part of the installation that is shown in FIG. 4, with a symbolic indication of the gas streams.

DETAILED DESCRIPTION OF THE INVENTION

FIGS. 1 and 2 show a device 1 for supplying cold gas to an NMR installation or analytical apparatus 2 that is equipped with a measuring probe 3, whereby said cold gases ensure the cooling of the sample 3' that is contained in the probe 3, but also its lift and rotation. This supply device 1 essentially comprises an insulated tank 4 that contains liquid gas 5 at boiling point and in which are arranged exchangers 6, 6', 6" through which the gas streams that are to be cooled pass, with these exchangers being connected to one or more transfer lines 7, 7', 7" (insulated or under vacuum) channeling the cooled gases to the probe 3.

In accordance with the invention, this device 1 also comprises at least one additional exchanger 8, 8', 8" that ensures a pre-cooling of the gas stream in question before it is channeled to the corresponding exchanger 6, 6', 6", whereby said or each additional exchanger 8, 8', 8" comes in the form of a double-flow (or counter-current) exchanger that is supplied either by the gaseous vapor 5' produced by the boiling of the liquid gas 5 in the tank 4 or by the cold gas 9 that is evacuated outside of the probe or that escapes at the probe 3.

The invention thus makes it possible to use the cooling capacity of the cold gases not currently used and usually directly evacuated into the atmosphere. The pre-cooling that results from the gas in question brings about a reduction of the thermal power to be transferred by the corresponding exchanger 6, 6', 6" and therefore a reduction of the refrigeration requirement by liquid nitrogen 5 (in which the exchangers 6, 6', 6" are arranged, in general inside of the temperature- and pressure-controlled chambers 6'").

This basic concept of the invention is preferably applied to the three cold gases.

Thus, according to the invention, it is provided that upstream relative to the gaseous stream in question, an additional pre-cooling exchanger 8, 8', 8", as FIG. 1 shows, is associated with each exchanger 6, 6', 6".

Also in accordance with the invention, the additional exchanger 8 that ensures the pre-cooling of the cold gas that is intended to cool the sample 3' is supplied with gaseous vapor 5' that is produced by the boiling of the liquid gas 5 in the tank 4, and the additional exchangers 8' and 8" that ensure the pre-cooling of the cold gases that are intended to ensure respectively the lift and rotation of the sample 3' are supplied by the gases 9 that are evacuated or that escape at the probe 3.

The supplying of dry gases for the lift and rotation of the probe 3 is thus ensured even after an extended shutdown of the installation 2 (because of the interdependence between the gas flows 9 and the lift and rotation gases as explained below).

Figure 3:
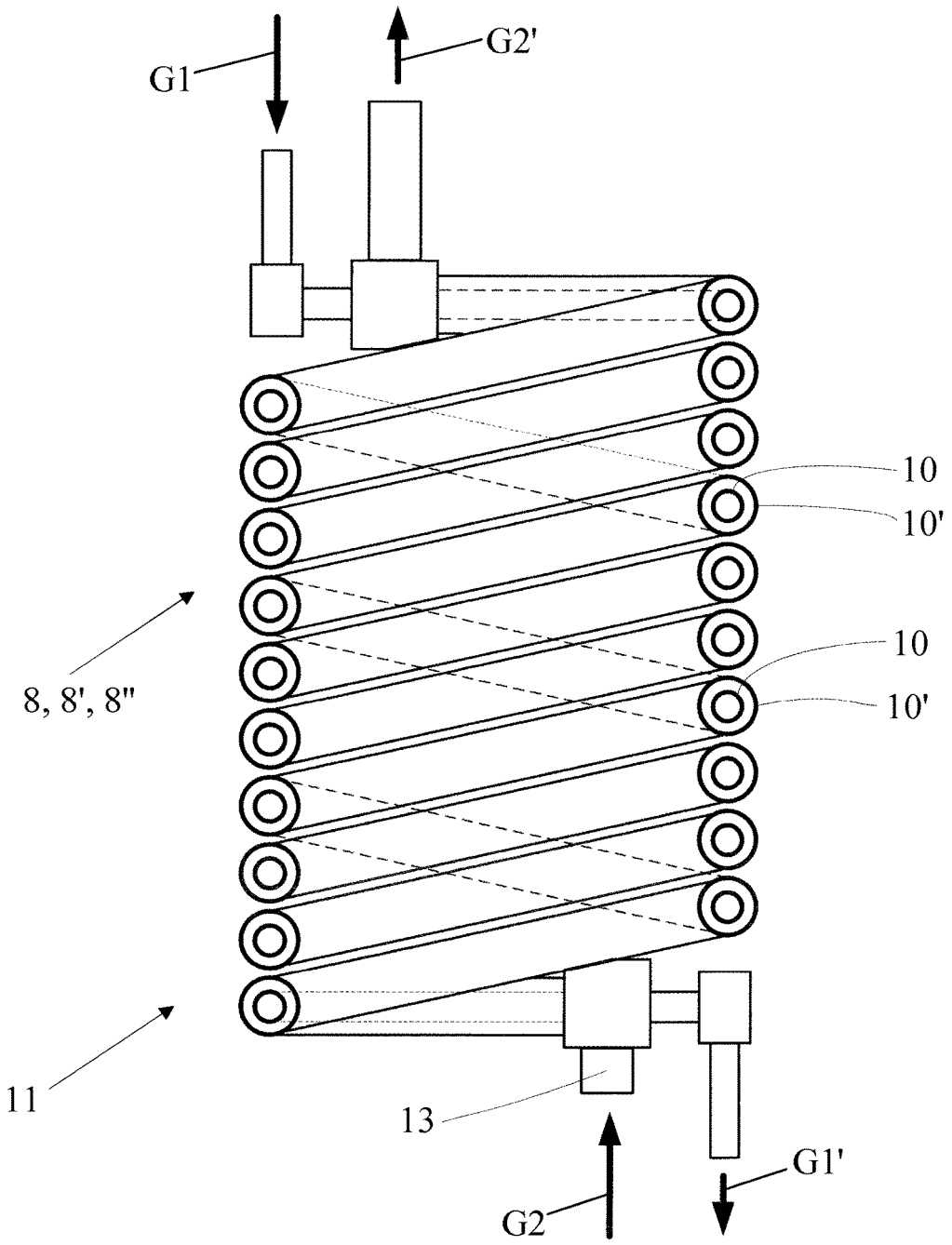
FIG. 3 is a cutaway view of the structural unit that is formed by the arrangement of additional exchangers according to a preferred variant of the device that is shown in FIGS. 1 and 2 (only the additional exchanger for the gas for cooling the sample is shown in full)

In accordance with an embodiment of the invention, ensuring an effective heat transfer and as shown in FIG. 3 of the accompanying drawings, each additional exchanger 8, 8', 8" consists of an arrangement of two concentric pipes or tubes 10, 10', one 10 through which the stream of gas to be pre-cooled passes (primary circuit), preferably the inner tube or pipe, and the other 10' (secondary circuit) through which the stream of cooling gas formed by the boiling gaseous vapor 5' of the liquid gas 5 of the tank 4 passes or through which the gases 9 that are evacuated or that escape at the probe 3 pass.

For the purpose of ensuring an optimal exploitation of the refrigerating power of the gaseous vapors 5' and exhaust gases 9, with a gradual pre-cooling, each additional exchanger 8, 8', 8" is advantageously a counter-current exchanger or an opposed-stream exchanger.

According to an advantageous design variant of the invention, as shown in FIGS. 2 and 3, and in order to build a compact and thermally optimized solution, the three additional exchangers 8, 8', 8" are grouped in a single structural unit 11, for example in the form of a single coil 11 that consists of an interlaced arrangement of three helical tubular formations 10, 10', each corresponding to one of the three additional exchangers 8, 8', 8".

As FIG. 2 shows, the additional exchangers 8, 8', 8", preferably grouped structurally in a single unit 11 housed in an insulated cylinder 11', are at least partially arranged in the upper portion 4' of the tank 4 that contains the liquid gas 5 and the exchangers 6, 6', 6" by advantageously being mounted in a cover 4" that closes said tank 4.

A nonlimiting, practical embodiment will now be described in detail and in relation to FIGS. 1 to 4 of the accompanying drawings.

As indicated above, the purpose of the invention is to reduce the consumption of liquid gas (generally nitrogen) in the NMR installations, in particular those that use LT MAS probes, and for this purpose, the general means used consists in pre-cooling all of the MAS gases before making them pass into the different exchangers 6, 6', 6".

For this purpose, the invention exploits the until now unused cooling power of all of the cold gases produced during the operation of the supply device 1 and the NMR probe 3.

In the current installations, two sources of easily exploitable cold gases have been identified by the inventor:

1) During the operation of the supply device 1, a boiling of the liquid nitrogen 5 occurs permanently in the main tank 4, caused by the cooling of the MAS gases in the chambers 6'" and the heat transfer toward the outside of these chambers. This very cold gas (nitrogen) is commonly called "boil-off." It is not used in the current design of these cooling devices, and it is simply discharged into the atmosphere by tubes that protrude on the top of the devices.

2) In the LT MAS NMR probe, the cold gases "VT," "Bearing," and "Drive" leaving the stator 3" are mixed in the inner volume of the probe 3. The resulting cold gas mixture is discharged outside of the probe into the atmosphere by an exhaust pipe that protrudes from the probe base. The envelope that constitutes the outer envelope 2' of the probe is well insulated thermally, and consequently, the exhaust gas remains at a low temperature. The temperature of the gas at the outlet, simply evacuated into the air currently, can be between 120 to 140K in continuous operation.

As FIGS. 2 and 4 show, a transfer pipe 12' for transferring the MAS gases to the probe 3, which is fixed on the box 11' that is insulated by an inner vacuum, is provided according to the invention. Advantageously, a sealing joint is located between the cover and the tank, and the cover is kept on the tank of liquid nitrogen by flanges.

In its preferred embodiment, the invention provides three pre-coolers 8, 8', 8" for the gases "VT," "Bearing," and "Drive."

Each additional exchanger that forms a gas pre-cooler is a counter-current exchanger, whose design is called "tube-in-tube" and which has a helical shape. In the inner tube 10 (for example, 8 mm), the gas to be cooled circulates from top to bottom (FIGS. 1 and 3). In the annular cross-section between the inner tube 10 and the outer tube 10' (for example, 16 mm), the cold gas for pre-cooling circulates from bottom to top. For example, the "VT" gas enters at ambient temperature, and the cold gas used for pre-cooling escapes to atmosphere at the upper end of the coil of FIG. 3. The pre-cooled VT gas exits at the bottom of the coil 11 and next passes into the exchanger 6. The three pre-coolers 8, 8', 8" for the gases "VT," "Bearing," and "Drive" are contained in the box 11'.

In FIG. 3, G1 shows the stream of VT gas at ambient temperature, G1' shows the stream of pre-cooled VT gas, G2 shows the stream of gas vapor 5' evacuated from the upper volume 4' of the tank 4, and G2' shows the stream of gas vapor 5' that escapes into the atmosphere.

The inputs of three additional exchangers that form the pre-coolers are supplied by the two sources of cold gases indicated above. More specifically:

1) The "VT" gas is pre-cooled by the "boil-off" cold gas (nitrogen) 5' produced in the tank 4 of liquid nitrogen 5 in which the exchangers 6, 6', 6" are immersed. This cold gas 5' passes through the inlet 13 of the outer pipe 10' for pre-cooling. As soon as the control of the pressure of the chambers 6'" is activated, i.e., as soon as the pressures of the chambers are constant, boiling occurs in the tank 4 around the chambers, and the cold gas that is produced (gaseous vapor 5') passes through the circuit that is formed by the outer tube 10' of the additional exchanger 8.

2) The cold gases at the outlet of the exchangers 6, 6', 6" are directed toward the probe by the transfer pipe 12' that is coupled to an insulated internal transfer line 14, housed in the bottom of the probe structure 3. The gases exit from the internal line close to the stator 3". The "BEARING" gas ensures the lift, the "DRIVE" gas ensures the spinning of the rotor, and the "VT" gas cools the central portion of the sample tube 3'.

3) The NMR probe 3 is thermally insulated by a double wall vacuum 2' (Dewar). Exiting from stator 3", the three gases are mixed in the internal volume of the probe 3 and exit by the exhaust pipe 15, outside of the box that closes the bottom probe structure 3 (FIG. 4).

The flexible vacuum-insulated return pipe 12 that is inserted into the exhaust pipe 15 of the NMR measuring probe is held by, for example, a nut and an O-ring seal. The other end of the line is inserted in an adapter 16 fixed under the cover 4" of the tank 4 of liquid nitrogen 5. It is held, for example, by a nut and a seal.

The adapter 16 distributes the cold gas (mixture of gases evacuated from the probe 3) toward the two inlets of the two pre-coolers 8' and 8" by two plastic tubes.

4) The heat exchange surface of each chamber 6'" is the upper portion that is not thermally insulated and that is used to transfer the thermal power toward the outside of the chamber, i.e., toward the liquid nitrogen 5 contained in the tank 4. The exchange surface of each chamber 6'" could be reduced by approximately 50% relative to the original version without pre-cooling. This reduction in surface area was made possible because the thermal power to be evacuated in each chamber is lower due to the pre-cooling of the MAS gases.

The specific assignment of the cold sources ("boil off" gas 5' and gas mixture 9 evacuated by the probe 3) respectively to the different pre-coolers 8, 8', 8" is essential for proper operation of the installation 4.

Thus, and as already mentioned above and illustrated by FIGS. 1, 2, 4 and 5 in particular, the cold gas 9 that comes from the probe 3 is used to pre-cool the "BEARING" and "DRIVE" gases. This cold gas ("exhaust") 9 that exits from the probe 3 is actually a gas that results from the mixture of all cold gases (VT, Bearing and Drive) exiting from the stator 3".

The VT gas is (at the unit 6/8) pre-cooled only by the so-called "boil-off" gas 5' of the $LN_2$ tank (reference 4). This "boil-off" gas of the $LN_2$ tank is produced continuously by the total thermal power dissipated in the liquid nitrogen. This is the sum of the thermal losses of the $LN_2$ tank 4 and thermal power dissipated by each chamber 6'" containing an exchanger 6, 6', 6" (the power released by each chamber is a function only of the internal pressure of this chamber).

This particular assignment has the advantage of avoiding problems linked to rotor spinning instabilities and rotor gas bearing.

Actually, during the periodic filling of the liquid nitrogen tank 4 for keeping its level approximately constant, the internal pressure of the tank significantly increases.

If, under these conditions, the boil-off gas 5' should be used, optionally in a mixture with the gas 9, for pre-cooling the DRIVE and BEARING gases, disruption of DRIVE and BEARING gas pressures would result more upstream from the probe 3. These variations would then produce fluctuations of the speed of rotation of the rotor 3', which would thereby become difficult to control. In addition, the cold gas 9 that is evacuated from the probe 3 is at a higher temperature (on the order of 120-140 K), which would increase the consumption of liquid nitrogen and the "boil off" of the tank 4.

When no gas circulates in the primary circuit 10 of a pre-cooler 8, 8', 8", or if the flow rate of the gas in question is low, it is recommended to stop the flow of cold gas in the secondary circuit 10' because a partial liquefaction of the gas of the primary circuit 10 could occur. Thus, if the boil-off gas (whose temperature is estimated at approximately 80 K) should be used to pre-cool the DRIVE or BEARING gases, which are under a pressure of 1 to 3 bar, it would be possible to partially liquefy these gases. However, this would seriously interfere with proper operation of the rotor 3' because the BEARING and DRIVE gases should be absolutely free from droplets of liquefied nitrogen gas.

In addition, during the insertion or ejection of the sample, the rotor 3' speed is shut down, and all of the flow rates of gases in the probe 3 are null. Consequently, the secondary flow rates of the BEARING exchanger 6' and the DRIVE exchanger 6" are also null, and BEARING and DRIVE gases that are present in the pre-coolers 8' and 8" cannot be liquefied. In contrast, if the boil-off gas 5' was used in the secondary circuit 10' of the BEARING pre-cooler 6' and DRIVE pre-cooler 6", there would exist an effective possibility of liquefaction of these gases. The design according to the invention thus avoids possible problems of rotation of the sample rotor 3.

In addition, in the particular case of the pre-cooler exchanger 8 for the VT gas, when the flow of primary gas is halted, the boil-off gas 5' still circulates in the secondary circuit 10'. However, partial liquefaction of the VT gas in this pre-cooler 8 is never noted because the pressure of the VT gas is then low (P<<0.5 bar), while the boil-off gas temperature is 80 K or more. In addition, if liquefaction should occur, this would not create any particular problem for proper operation of the probe 3 because the VT gas does not influence the rotation or the lift of the sample.

Owing to specific arrangements of the invention, it was possible to reduce very significantly the consumption of liquid nitrogen while ensuring the quality and the characteristics of the gases sent to the probe 3.

With a prototype, it was possible for the inventor to measure a consumption of 6.5 l/LN2 per hour (with a 3.2 mm rotor rotating at 8 KHz). A reduction of more than approximately 50% relative to the consumption measured on a known equivalent supply device, not exhibiting the characteristics of the invention as shown in the description above, was thus achieved.

The reduction of the consumption of liquid nitrogen reduces the number of times that auxiliary liquid nitrogen tanks, used to keep the level of liquid nitrogen constant in the main tank, are handled.

Owing to the invention, there are therefore fewer operations of installations and connections of tanks to be done each day. Thus, a single 200-liter tank of LN2 is sufficient to ensure continuous operation for 24 hours for moderate speeds of rotation of the rotor, i.e., less than 10 KHz with a probe equipped with a 3.2 mm rotor.

The invention also has as its object an NMR measuring installation 2, in particular of the LT MAS probe type, in which the probe 3 is supplied with cold gases ensuring the cooling (VT), the lift (BEARING), and the rotation (DRIVE) of the sample (rotor 3'), whereby said installation 2 comprises and/or has a fluid connection to a device 7, 7', 7" for supplying cold gases, channeling these gases by means of respectively corresponding supply lines (FIGS. 4 and 5).

This installation 2 is characterized in that the supply device is a supply device 1 as described above.

As indicated above, this installation 2 advantageously comprises a transfer pipe 12 that is thermally insulated and preferably flexible, designed to channel the gases 9 that are evacuated or that escape from the probe 3 toward the additional exchanger(s) 8', 8" and that connects the exhaust pipe 15 of the probe 3 to the tank 4 containing the liquid gas 5.

Of course, the invention is not limited to the embodiments described and shown in the accompanying drawings. Modifications are possible, in particular from the standpoint of the composition of various elements or by substitution of technical equivalents, without thereby exceeding the field of protection of the invention.

The invention claimed is:

1. A device for supplying three cold gases to an NMR installation or analytical apparatus that is equipped with a measuring probe, with said cold gases ensuring the cooling of the sample that is contained in the probe, but also lift and rotation of the probe, comprising:

an insulated tank containing liquid gas at boiling and in which are arranged three heat exchangers through which gas streams that are to be cooled pass, with the exit of each heat exchanger being connected to a corresponding transfer line, said lines being vacuum insulated and channeling the cooled gases exiting the heat exchangers to the probe, three separate additional pre-cooling heat exchangers, which are a first, a second and a third additional pre-cooling heat exchanger, each additional pre-cooling heat exchanger being configured for pre-cooling of one of the three gas streams before said gas stream is channeled to the corresponding heat exchanger, with each additional pre-cooling heat exchanger being a double-flow exchanger, each additional pre-cooling heat exchanger being associated with a corresponding specific heat exchanger, wherein the three gases are VT cooling gas, bearing gas and drive gas for the sample, each additional pre-cooling heat exchanger is supplied either by i) recovered boil-off gas which is gaseous vapor produced by the boiling of the liquid gas in the tank or by ii) recovered escape gas which is a cold gas that is evacuated outside of the probe or that escapes at the probe, according to a specific allocation pattern of cold sources relative to the additional pre-cooling heat exchangers, that is to say the first additional pre-cooling heat exchanger, which ensures the pre-cooling of the VT cooling gas designed to cool the sample is supplied with the recovered boil-off gas only, and the second and third additional pre-cooling heat exchangers, which ensure respectively the pre-cooling of the two dry gases designed to provide respectively the lift and the rotation of the sample, namely the bearing gas and the drive gas, are supplied with the recovered escape gas only.

2. The device according to claim 1, wherein each additional pre-cooling heat exchanger is an arrangement of two concentric pipes or tubes, one through which the stream of gas that is to be pre-cooled passes before entering the corresponding heat exchanger, and the other through which the stream of cooling gas formed by the boil-off gas or the escape gas passes, before said gases exit into the environment.

3. The device according to claim 1, wherein each additional pre-cooling heat exchanger is a counter-current pre-cooling heat exchanger or an opposed-stream pre-cooling heat exchanger.

4. The device according to claim 1, wherein the three additional pre-cooling heat exchangers are grouped in a single structural unit, in a form of a single coil that is an interlaced arrangement of three helical tubular formations, each corresponding to one of the three additional pre-cooling heat exchangers.

5. The device according to claim 1, wherein the additional pre-cooling heat exchangers are housed in an insulated tank, are at least partially arranged in an upper portion of the tank that contains the liquid gas and the heat exchangers, by being mounted in a cover that closes said tank.

6. An NMR measuring installation, of a LT MAS probe configuration, in which the probe is supplied with cold gases ensuring the cooling, the lift, and the rotation of the sample, whereby said installation comprises and/or has a fluid connection to a supply device for supplying cold gases, channeling these gases by means of respectively corresponding supply lines, and wherein the supply device is the device according to claim 1.

7. The installation according to claim 6, further comprising a transfer pipe that is optionally thermally insulated and flexible, designed to channel the gases that are evacuated or that escape from the probe toward the additional pre-cooling heat exchanger(s) in question, and that connects the exhaust pipe of the probe to the tank with liquid gas.

8. The device according to claim 2, wherein each additional pre-cooling heat exchanger is a counter-current pre-cooling heat exchanger or an opposed-stream pre-cooling heat exchanger.

9. The device according to claim 1, wherein each additional pre-cooling heat exchanger is an arrangement of two concentric pipes or tubes, the inner tube or pipe of the two concentric pipes through which the stream of gas that is to be pre-cooled passes, and the other through which the boil-off gas or the escape gas pass.

10. The device according to claim 1, wherein the additional pre-cooling heat exchangers are grouped structurally in a single unit, are housed in an insulated tank, and are at least partially arranged in an upper portion of the tank that contains the liquid gas and the exchangers, by being mounted in a cover that closes said tank.

* * * * *